United States Patent [19]

DeShano

[11] 4,160,298

[45] Jul. 10, 1979

[54] CAPSULE FOR A LIFE SAVING LINE AND FLOAT

[76] Inventor: Al DeShano, 3693 Scott Ave., Shandon, Ohio 45063

[21] Appl. No.: 880,049

[22] Filed: Feb. 22, 1978

[51] Int. Cl.[2] ..... B63B 21/52

[52] U.S. Cl. ..... 9/14; 9/9; 43/43.1

[58] Field of Search ..... 43/43.1; 9/9, 8 R, 14

[56] References Cited

U.S. PATENT DOCUMENTS

| | | | |
|---|---|---|---|
| 2,192,203 | 3/1940 | Purdy | 9/14 |
| 3,997,930 | 12/1976 | Reeves | 9/9 |

FOREIGN PATENT DOCUMENTS

| | | | |
|---|---|---|---|
| 2506241 | 8/1976 | Fed. Rep. of Germany | 9/14 |

*Primary Examiner*—Trygve M. Blix

*Assistant Examiner*—D. W. Keen

*Attorney, Agent, or Firm*—Thomas E. Beall, Jr.

[57] ABSTRACT

A standard container having the usual filling neck with threads is converted into a device for throwing a lifeline from a safe area, such as a boat, over open water to a desired spot where it functions as a buoy and tow rope. After removal of the standard cap, a replacement cap is telescopically threaded to the standard container neck, and includes a tube extending into the container and being closed at its bottom end, so as to render the container water tight, after a small amount of water has been added to the otherwise empty container for ballast. The line is stored within the replacement cap tube, and is secured to the bottom of the tube. The top end of the tube is closed by an easily removable cap that is secured to one end of the line and forms an anchor for one end of the line to be held in one hand, while the container is thrown with the other hand.

10 Claims, 3 Drawing Figures

CAPSULE FOR A LIFE SAVING LINE AND FLOAT

BACKGROUND OF THE INVENTION

The present invention relates to floats or buoys attached to one end of a line that may be used as lifelines to a swimmer in need of help, when the other end of the cord is held at a safe area, or used as marking buoys, when the other end of the line is attached to an anchor dropped in the water.

U.S. Pat. No. 3,911,515 to Rinfret et al discloses a device to be used as a lifeline, which may be carried on board a vessel and disassembled so that one end may be thrown to a swimmer in need of help while the other end of the line is maintained on board ship. There are a number of disadvantages of this device. The device is too complex and costly to be widely used. A main portion of the weight in the throwing part is the coiled line, which, of course, weight will become less as the line is uncoiled, therefore making accurate throwing difficult. However, accurate throwing is essential, because the portion thrown is very small and not easily seen by the swimmer needing help, once it strikes the water. This prior art device may be used only once, which makes practice throws almost impossible, because the coil is coiled on a spool where it cannot be recoiled accurately because the center spindle and narrow neck are likely to cause jamming if the cord is stuffed back into the bottle. Further, the open bottle that is used as a buoy to strike the water has a very small cubic inch displacement that makes floating difficult, and further the bottle may easily fill with water so that it may quickly sink.

SUMMARY OF THE INVENTION

It is an object of the present invention to overcome the disadvantages mentioned above with respect to the prior art, particularly by providing an inexpensive device that recycles a standard container partially filled with water as a ballast to economically, simply and reliably obtain a marking buoy or a lifeline buoy.

Although useable on docks, at swimming pools, and the like, the present invention will mainly be described with respect to storage and use on board boat for purposes of a specific illustration, although it is to be realized that the invention may be used between any safe area, such as those mentioned above, and an open body of water. The present invention may be used as a marking buoy, but is primarily designed to be used as and will be described with respect to a device to throw a lifeline to a swimmer in need of help.

A container having a standard size cap, such as a one-gallon container, may be originally purchased for its contents, such as detergent, anti-freeze, oil, or the like. After its contents have been used or otherwise emptied, a small amount of water is placed in the now empty container, for ballast, and the standard cap that was used for sealing the standard threaded filling neck has been discarded. A replacement cap, according to the present invention, is then inserted into and threaded on the filling neck of the container. This replacement cap is tightly threaded to the filling neck of the container and seals the interior of the container so as to trap the small amount of water, as ballast, and the large amount of air within the container. The water within the container provides weight, so that the container may be easily thrown over a considerable distance across a body of open water, and the trapped air within the container allows the container to function as a float for easy visibility, and as a flotation device to assist a swimmer in need of help to remain afloat after the container reaches its destination on the open body of water.

The replacement cap contains a tube, with a closed bottom, depending downwardly from the threaded neck and a spindle freely projecting upwardly from the bottom of the tube to form with the tube an annular chamber containing a coiled line or cord having one end secured to the replacement cap, and its other end secured to an easily removable hand-held cap.

When it is desired to use the device to assist a swimmer in need of help, for example, the replaceable hand-held cap is removed and held in the left hand (for a right-handed thrower), a suitable length of cord is removed, for example five feet, and the container is then thrown with the right hand, with an underhand swing, across the open body of water toward the swimmer in need of help. During the throwing, the thrower tightly holds onto one end of the cord by means of the removable hand-held cap, and as the container travels across the body of water, the cord will unwind from the spindle. When the container reaches its destination and plunges into the water, it will remain afloat and will not fill up with water, because the replacement cap and closed end tube seals the container so that additional water cannot enter the container. Due to its relatively large size, the container may be easily seen by the swimmer in need of help, and further due to its rather large flotation volume, the container may be used by the swimmer to assist the swimmer in remaining afloat, but in any event provide a rather large object to grab hold of while the cord or line is used to tow the boat and swimmer in need of help toward each other.

BRIEF DESCRIPTION OF THE DRAWING

Further objects, features and advantages of the present invention will become more clear from the following detailed description of a preferred embodiment, with reference to the drawing, wherein.

DETAILED DESCRIPTION

Figure 1:
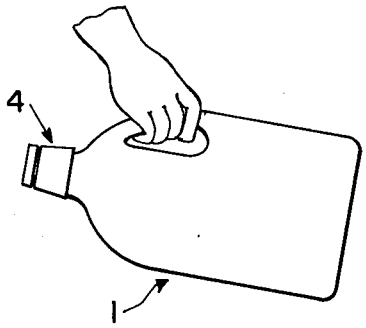
FIG. 1 is a perspective view of a standard container employing the replacement cap of the present invention.

The present invention employs a standardized container, which for example, may be a standard one gallon container 1, that is closed except for a neck 2 having a filling opening. The container may be made of glass, metal, or plastic, and may be in various configurations, such as round, square, rectangular, conical, or triangular, and further should employ a handle. In any event, such standardized containers employ filling necks that are more standardized than the shape of the container body, so that one standard cap may fit a plurality of different types of containers. The neck 2 is provided with external threads 3, and it is to be understood that, particularly with thin plastic wall containers, the neck may also inherently have inner (not shown) threads formed on it.

After the contents, for which the container 1 was originally purchased, have been used or otherwise emptied from the container, a small amount of water (substantially less than one half of the volume of the container) is added to the container for purposes of ballast when the container is to be thrown for dispensing a lifeline. Thereafter, a replacement cap is secured to the neck of the container after the standardized cap has been thrown away. This replacement cap 4 will completely seal the interior of the container, so that further water or air may not enter the container, and so that the water within the container may not be released from the container.

The replacement cap 4 is preferably molded from a synthetic resin, to include a depending annular skirt 5 having internal threads 6 that securely mate with the external threads 3 of the neck 2. The upper end 7 of the skirt 5 extends inward as an angular flange formed in one piece with the upper portion of a tube 8. The tube 8, flange 7, and skirt 5 are preferably constructed in one piece by molding. The bottom end of the tube 8 is sealed by it being connected with a disc 9, also of synthetic resin, that may be sealingly secured about its periphery to the bottom end of the tube 8 by an adhesive, by friction welding, or in any other manner. In this manner, the replacement cap seals the dispensing opening of the container 1.

Extending upwardly from the disc 9, there is a conical spindle 10, which is coaxial with and spaced from the tube 8, which tube 8 is preferably circular in cross section to match the corresponding circular shape of the neck 2. A cord or line 11 has one end 12 that passes through a diametric hole in the bottom of the spindle 10, and is further formed into a knot 13, to securely anchor the one end of the line to the replacement cap. The remainder of the line 11 is wrapped around the spindle 10 in a storage coil.

The upper open end of the chamber formed within the tube 8 is sealingly closed by means of a removable cap 14. The cap 14 has a main body, which is disc shaped, 15, a depending skirt 16, and a depending securement body 19. The skirt 16 has projection 17 that releasably engages projection 18 on the uppermost end of the tube 8, to securely hold the cap in sealing engagement on the top of the tube 8. This connection 17, 18 may be a threaded or bayonet type of connection. The outermost diameter of the skirt 16 generally should be clearly separate from the skirt 5. The other end 20 of the line 11 passes through a hole within the securement body 19 of the removable cap 14, and is knotted at 21, to form a secure connection between the other end 20 of the line 11 and the removable cap.

The preferred embodiment is illustrated in its normal position, wherein the filling opening points upward, and for purposes of illustration and orienting the elements with respect to each other, the specification and claims refer to such vertical orientation, but such is for convenience only and to show relative orientation between the elements, and otherwise is not restricted.

While the skirt 5 has been shown as being threaded to the outer portion of the neck of the container, which is preferable, it is to be understood that if the neck has internal threads, the tube 8 may be formed with external threads for sealing cooperation therewith.

While it is desirable for the removable cap 14 to seal the chamber within the tube 8, such is not necessary. Further, the removable cap 14, instead of being a specially constructed item, could in fact be the standardized cap that originally came with the container 1, and for this modification (not shown in the drawing), the topmost portion of the tube 8 could be provided with external threads substantially the same as the external threads of the neck 2, and further the other end 20 of the line could be passed through a hole punched in the standardized cap and thereafter knotted. Another advantage of using a specially formed cap, such as shown in the drawing, is that the replacement cap and the removable cap would be securely held together and would require very little assembly while at the same time preventing misplacement of the other end of the line or uncoiling of the line prior to assembly with the container 1.

After assembly of the device as noted above, the device could be stored on board ship or on board the boat until such time as it was needed. When needed, for example to throw a lifesaving line to a swimmer in need of help, the operation would be as follows. The cap 14 would be removed, held in the left hand (for a right-hand thrower), a small amount of the line 11 would be removed from the coil (for example 5 feet), and the container 1 would be held in the right hand. After this, the container 1 would be thrown over the open water toward the swimmer in need of help while retaining a firm grip on the removable cap 14 that would then function as the line holder. In throwing, the container would most likely be thrown with an under-hand motion, and the small amount of water within the container would function to provide ballast so the container could be thrown quite far and with considerable accuracy. As the container travels through the air over the open body of water after being thrown, the line 11 uncoils from the spindle 10 and is dispensed from the open upper end of the tube 8 through the dispensing opening of the neck 2 of the container. It is contemplated that a considerable amount of line may be held within the tube 8, for example 50 or 100 feet. After the container reaches the vicinity of the swimmer in need of help, the container will float high in the water with good visibility and with great stability, since the water ballast in the bottom will tend to hold the container upright, and further the air sealed within the container will make sure that the container floats. When the swimmer reaches the container, the container may be used as a flotation device to assist the swimmer in remaining afloat, because the replaceable cap tightly seals the interior of the container and will prevent leakage of water within the container. Thereafter, the end 20 of the line, which remains attached to the removable cap 14 held by the thrower, may be used to tow the swimmer and the boat towards each other.

Figure 2:
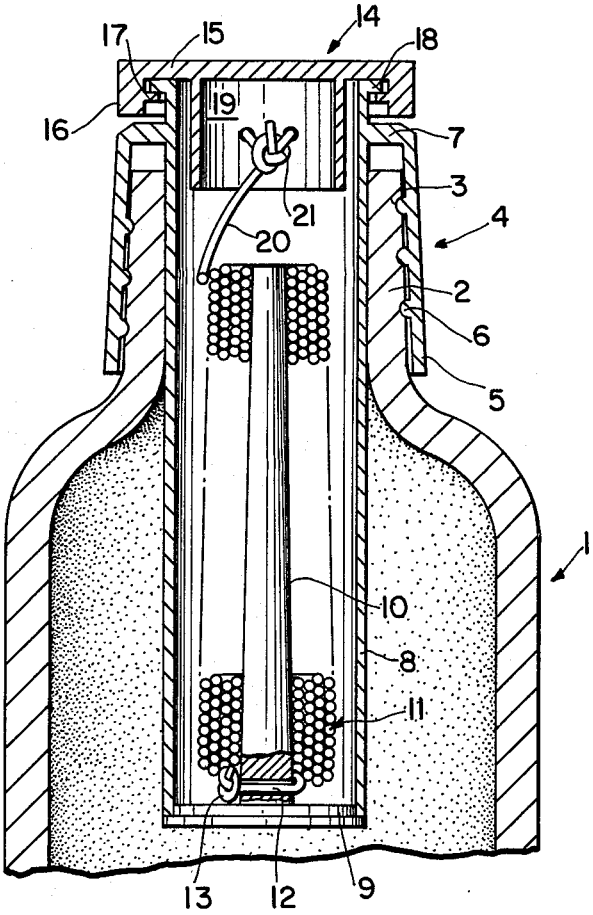
FIG. 2 is a partial longitudinal cross sectional view of the container of FIG. 1, showing details.
Figure 3:
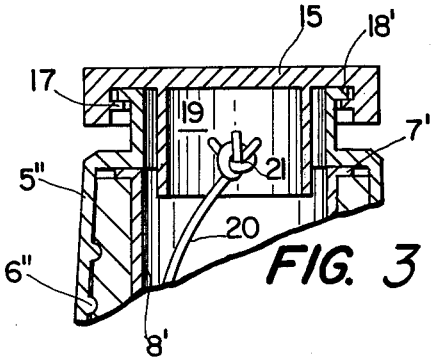
FIG. 3 shows another embodiment.

The embodiment of FIG. 4 differs structurally from that of FIG. 2 only by separating the tube 8' from the cap 5'' so that flange 7' of the tube 8' is clamped by the cap 5''. Operation is identical to that of FIG. 2.

A preferred plastic would be polyethylene, or polypropylene for the embodiments. A preferred line to be used is 210 pound multifilament twisted nylon.

While preferred embodiments of the present invention have been illustrated and described in detail, both for purposes of illustration and the importance of the details, further embodiments, variations and modifications are contemplated and have partially been set forth, all according to the spirit and scope of the following claims.

I claim:

1. A life saving capsule for storing a life saving line within a standard container and thereafter dispensing the line when the container sealed by a portion of the capsule is thrown to a person within open water, said capsule being a replacement cap for a standard product container, said capsule including:

an annular threaded portion for a telescopic threaded engagement with the neck of the container;

a line holder releasably attached to said annular portion;

a fixed length of line having one end secured to said line holder and its opposite end secured by said annular portion to said container;

means to be held within said container by said annular portion for storing the line in an easily dispensable condition immediate its ends within the container;

means sealing the neck of the container when the annular portion is in tight threaded engagement with the neck of the container with the line holder removed and permitting dispensing of the full length of line between the line holder and container as the container is thrown across open water from a position where the line holder is retained.

2. The capsule according to claim 1, wherein said sealing means is a tube extending from the outer portion of said neck where it is secured by said annular portion through said neck to the interior of said container and means sealingly closing the inner end of said tube.

3. The capsule according to claim 2, wherein said tube is formed in one piece with said annular portion.

4. The capsule of claim 2, wherein said sealing means includes an outwardly extending annular flange on the outermost end of said tube, and said annular portion includes an inwardly extending annular flange overlapping said tube outwardly extending flange when assembled.

5. The capsule according to claim 2, wherein said storing means includes a spindle having an upper free end and a lower end secured to said means closing the inner end of said tube so as to form with said tube an annular chamber containing therein the stored portion of said line.

6. The capsule according to claim 5, wherein said tube is formed in one piece with said annular portion.

7. The capsule according to claim 5, wherein said sealing means includes an outwardly extending annular flange on the outermost end of said tube, and said annular portion includes an inwardly extending annular flange overlapping said tube outwardly extending flange when assembled.

8. The capsule according to claim 1, wherein said sealing means is a disc secured around its outer periphery to said annular portion, and said storing means is a cylindrical cup-shaped member for extending into the container and holding therein the stored line, and having its outer end provided with an outwardly extending flange to be clamped between the outermost end of the neck and said disc.

9. A method of constructing a life saving device, storing a life saving line, and deploying a life saving line from an area of safety across open water to a person within the water, comprising the steps of:

providing an empty standard container having a dispensing neck, with threads on the neck for normally securing a conventional sealing cap;

replacing the normal contents of the container with ballast only filling the container for less than one half of its volume, with air filling the remainder of the volume;

replacing the conventional cap with a replacement cap having a line storage holder carrying a fixed quantity of the line, so that the line may be stored within the container;

sealing the container dispensing opening with the replacement cap so that the air trapped within the container will permit the container to function as both a float and flotation device;

securing one end of the line to the replacement cap and securing the opposite end of the line to a line holder;

removably securing the line holder to the container and replacement cap;

thereafter storing the container with ballast and replacement cap until needed;

when needed, removing a portion only of the replacement cap having an end of the line secured to it;

securing the removed end of the line at the area of safety, grasping the container in one hand, and throwing the container sealed by the replacement cap with the ballast in it toward the person in the water;

dispensing the line from its storage holder as the container travels over the open water after being thrown until the container strikes the water and functions as a highly visible float holding the one end of the line; and holding the container floating on the water by the person within the water to provide a flotation device to assist the person in the water to remain afloat and simultaneously towing the person in the water toward the area of safety by pulling in the line starting at the end secured at the area of safety.

10. The method according to claim 9, wherein said step of dispensing maintains the stored quantity of the line within the container and dispenses the line through the neck of the container as the container travels over the open body of water after being thrown.

* * * * *